US008322265B1

(12) United States Patent
Singer

(10) Patent No.: US 8,322,265 B1
(45) Date of Patent: Dec. 4, 2012

(54) LUBRICATION SYSTEM AND METHOD FOR ELECTROMAGNETIC LAUNCHER

(75) Inventor: Irwin L. Singer, Alexandria, VA (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 268 days.

(21) Appl. No.: 12/822,794

(22) Filed: Jun. 24, 2010

Related U.S. Application Data

(60) Provisional application No. 61/219,907, filed on Jun. 24, 2009.

(51) Int. Cl.
*F41F 1/00* (2006.01)

(52) U.S. Cl. ..... 89/8; 124/3; 310/12.07

(58) Field of Classification Search ..... 89/8; 124/3; 310/12.07
See application file for complete search history.

(56) References Cited

U.S. PATENT DOCUMENTS

| | | | | |
|---|---|---|---|---|
| 1,985,254 | A * | 12/1934 | Huse | 310/13 |
| 5,005,484 | A * | 4/1991 | Witt | 102/501 |
| 5,191,164 | A * | 3/1993 | Hawke et al. | 89/8 |
| 5,237,904 | A * | 8/1993 | Kuhlmann-Wilsdorf | 89/8 |
| 8,109,190 | B2 * | 2/2012 | Proulx | 89/8 |

OTHER PUBLICATIONS

U.S. Appl. No. 12/822,826.

* cited by examiner

*Primary Examiner* — Gabriel Klein
(74) *Attorney, Agent, or Firm* — Amy L. Ressing; L. George Legg

(57) ABSTRACT

In an electromagnetic rail gun launcher that includes a set of spaced-apart rails defining an inside bore for slidably receiving an armature-type projectile, with the rail gun and armature configured such that when powered up the projectile is forced from a breech of the rail gun toward a muzzle of the rail gun to then launch the projectile, the improvement wherein a lubricant reconditioning pad, containing a lubricant, is secured to the projectile in a location such that it contacts the rails. As the projectile moves through the bore, the pad cleans debris from, and applies lubricant to, the rails to thereby lubricate and recondition the rails during each shot.

19 Claims, 12 Drawing Sheets

(CURRENT THRU FORWARD CONTACTS IS << THAN IN REAR CONTACTS)

LUBRICATION SYSTEM AND METHOD FOR ELECTROMAGNETIC LAUNCHER

CROSS-REFERENCE TO RELATED APPLICATIONS

This Application claims the benefit of U.S. Provisional Application 61/219,907, filed on Jun. 24, 2009 and incorporated herein by reference. This application is related to U.S. Application No. 12/822,826, filed concurrently herewith and issued on Dec. 20, 2011 as U.S. Pat. No. 8,079,352.

FIELD OF THE INVENTION

The invention is directed to materials and methods for lubricating and conditioning the rail/armature interface of an electromagnetic launcher, also known as a rail gun. More particularly, the invention is directed to lubricating and conditioning electrically-conducting rails and armatures before use and during launch.

BACKGROUND OF THE INVENTION

In electromagnetically-driven rail guns, two metallic rails in the gun barrel (bore) serve as electrodes that conduct current to a metallic armature wedged tightly between the rails. The armature is placed at the back of the projectile that delivers a payload. A fast, high-current pulse loops through the rails via the armature, generating a magnetic field that couples with the current passing through the armature to produce a force that accelerates the projectile down the barrel at supersonic speeds. Exemplary electromagnetic (EM) rail guns are described in U.S. Pat. No. 7,409,900. Nechitailo et al., issued Aug. 12, 2008; U.S. Pat. No. 7,077,047, J. F. Frasca, issued Jul. 18, 2006; U.S. Patent Application No. 20080053299, R. J. Taylor, publication date Mar. 6, 2008: and U.S. Patent Application No. 20070277668, J. F. Frasca, publication date Dec. 6, 2007: all of which are incorporated herein by reference. In presently-designed guns, it has been found that the both the rail and the armature are badly damaged by a combination of arcing, interfacial heating, frictional rubbing and gouging, leading to arc erosion, plowing wear and melting of either or both armature and rail. Although an armature is used only once, loss of armature material, e.g., Al from the low melting temperature Al armature, leads to contamination of rails with metal deposits and, worse, loss of contact between the remaining armature and rail. If the armature metal does not melt (e.g., Cu), arcing at the onset of sliding damages the rail by adding splats of eroded armature material, eroding rails at the arc strike location and oxidizing, via heating, areas surrounding the arc strike. As damage accumulates, the gun becomes less reliable on subsequent shots and bore life is diminished. The present invention will dramatically increase bore life by allowing projectiles to be fired hundreds of shots with minimal arcing and wear damage to both rails and armatures.

Lubrication is a primary approach for reducing damage to sliding contacts for electromechanical devices, however, there have been few efforts to date to determine the efficacy of lubricants in the specific application of rail guns. Traditional hydrocarbon lubricants are ineffective, both because they are non-conducting and ignitable. Solid lubricants based on graphite have been discussed in the literature, but none has been demonstrated to work effectively. One problem with graphite and metal-graphite solids is that their transfer films are patchy, and since graphite can be very resistive, patches can result in large voltage drops along the interface. Other solids like molybdenum disulphide and other dichalcogenides are lubricous, but not very conductive. Finally, the polymer polytetrafluoroethylene ("PTFE"—best known by the commercial name Teflon®) is a low friction material, but it is a poor conductor (as a bulk solid, it is $10^{18}$ times less conductive than Cu). Thin conductive metal films can act as lubricants in solid vs. solid sliding contacts so long as the metal film has much lower shear strength than either metal. The problem remains of how to 'coat' the solids with the film run after run, which then presents another problem that hasn't been addressed of how to provide lubrication of the gun during or after each firing.

BRIEF SUMMARY OF THE INVENTION

According to the invention, in an electromagnetic rail gun launcher that includes a set of spaced-apart rails defining an inside bore for slidably receiving an armature-type projectile, with the rail gun and armature configured such that when powered up the projectile is forced from a breech of the rail gun toward a muzzle of the rail gun to then launch the projectile, the improvement wherein a lubricant reconditioning pad, containing a lubricant, is secured to the projectile in a location such that it contacts the rails. As the projectile moves through the bore, the pad cleans debris from, and applies lubricant to, the rails to thereby lubricate and recondition the rails during each shot.

For lubrication to be effective, the rail is preferably conditioned for the lubricant to be applied effectively to a surface, especially a just-shot surface. Conditioning removes contaminants that attach to or cover the rail: conditioning scrapes and textures the rail to make lubrication easier; and finally, conditioning treats the chemistry of the surface to accept lubrication.

The lubrication scheme disclosed herein affords better projectile performance and longer gun barrel life. The conditioning film provides better interface sliding, electrical contact and post-sliding protection to the rail.

DETAILED DESCRIPTION OF THE INVENTION

Figure 1:
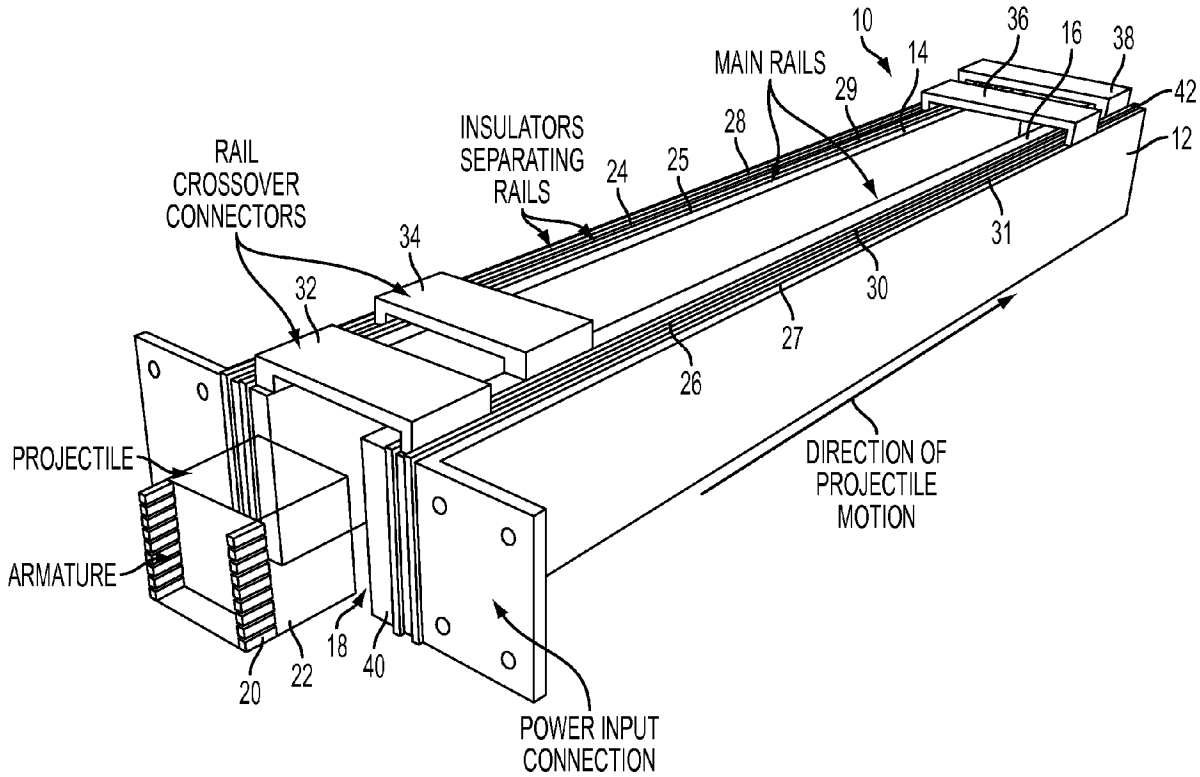
FIG. 1 is an elevation view of a representative electromagnetic rail gun launcher to which the lubrication system and method are applied according to the invention.

Referring now to FIG. 1, an electromagnetic rail gun launcher 10 has a barrel 12 integrated into which are main rails 14 and 16 that are spaced apart so as to form a bore 18 therebetween for slidably receiving an armature 20 that to which is attached a projectile 22, for example an electronic warfare countermeasure device such as a decoy to launch from a ship or an aircraft. Launcher 10 includes augmenting rails 24, 25, 26 and 27 separated from main rails 14 and 16 and one another by insulators 28, 29, 30, and 31. Rail crossover connectors 32, 34, 36, and 38 electrically connect the sets of rails as shown such that when energized, current flows through the rails and a large magnetic field is generated. The armature 20 carries a current perpendicular to the magnetic field with a resultant force that acts on armature 20 to move from a breech 40 to a muzzle 42 of launcher 10 and thereby launch the projectile 22 at its design exit velocity.

Figure 2:
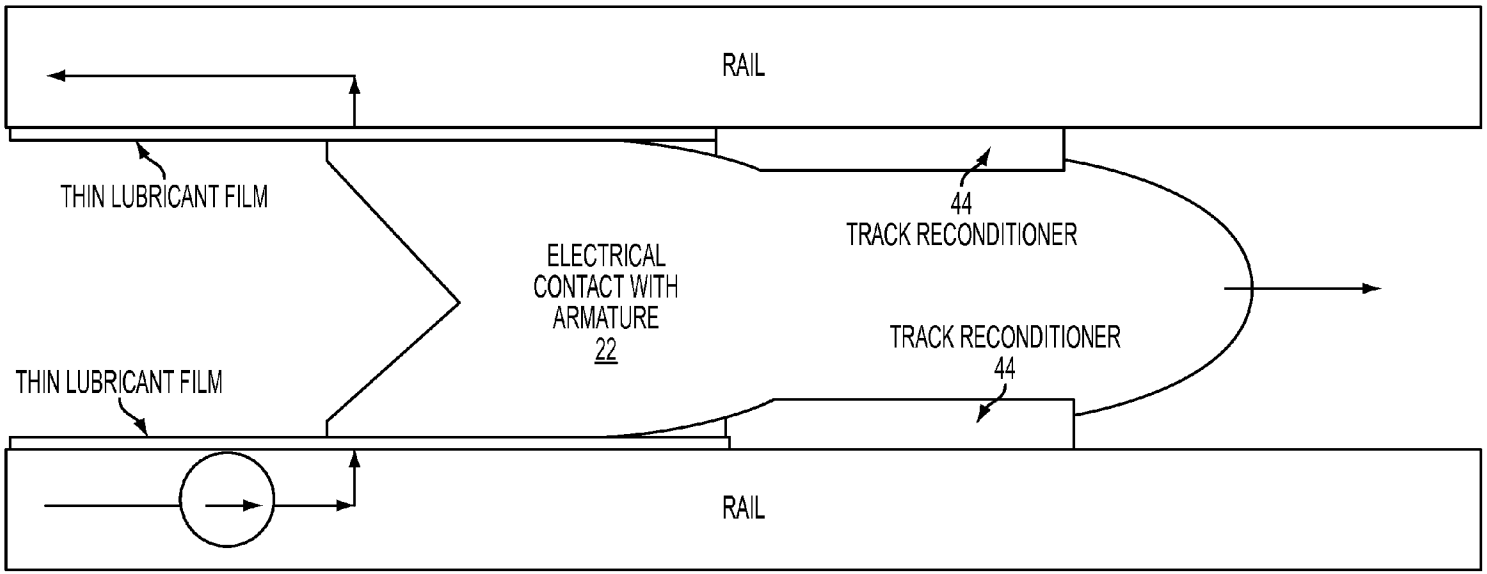
FIG. 2 is a cross-sectional view of a rail gun track system with lubrication pads according to the invention.
Figure 3:
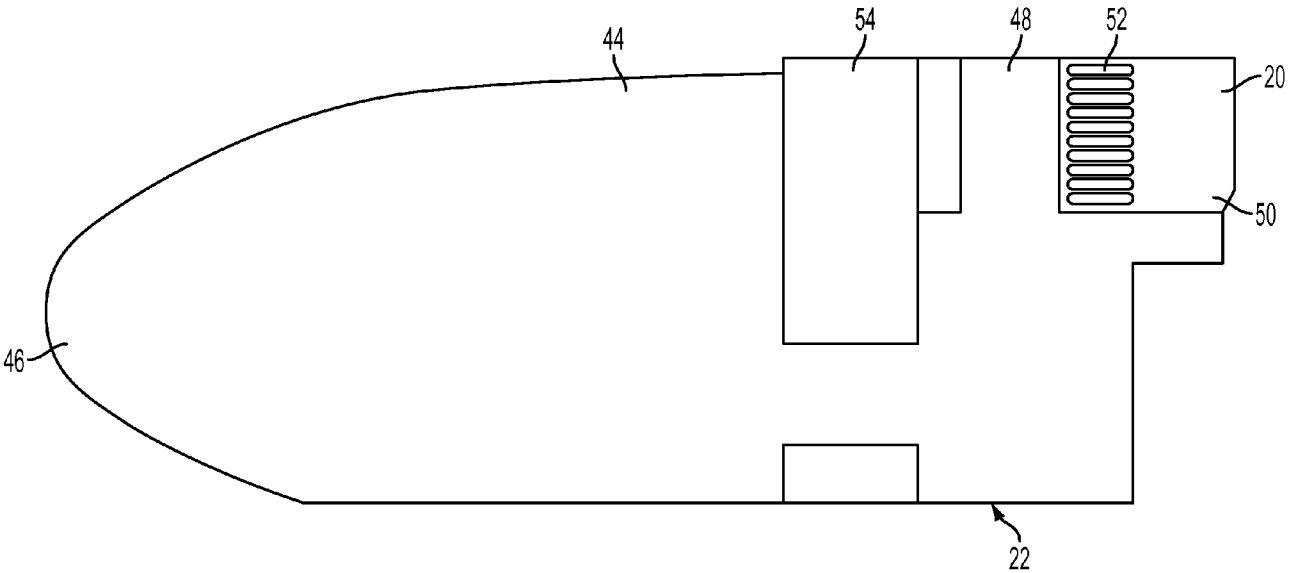
FIG. 3 shows an armature-projectile with lubricating/conditioning pads according to the invention.
Figure 4:
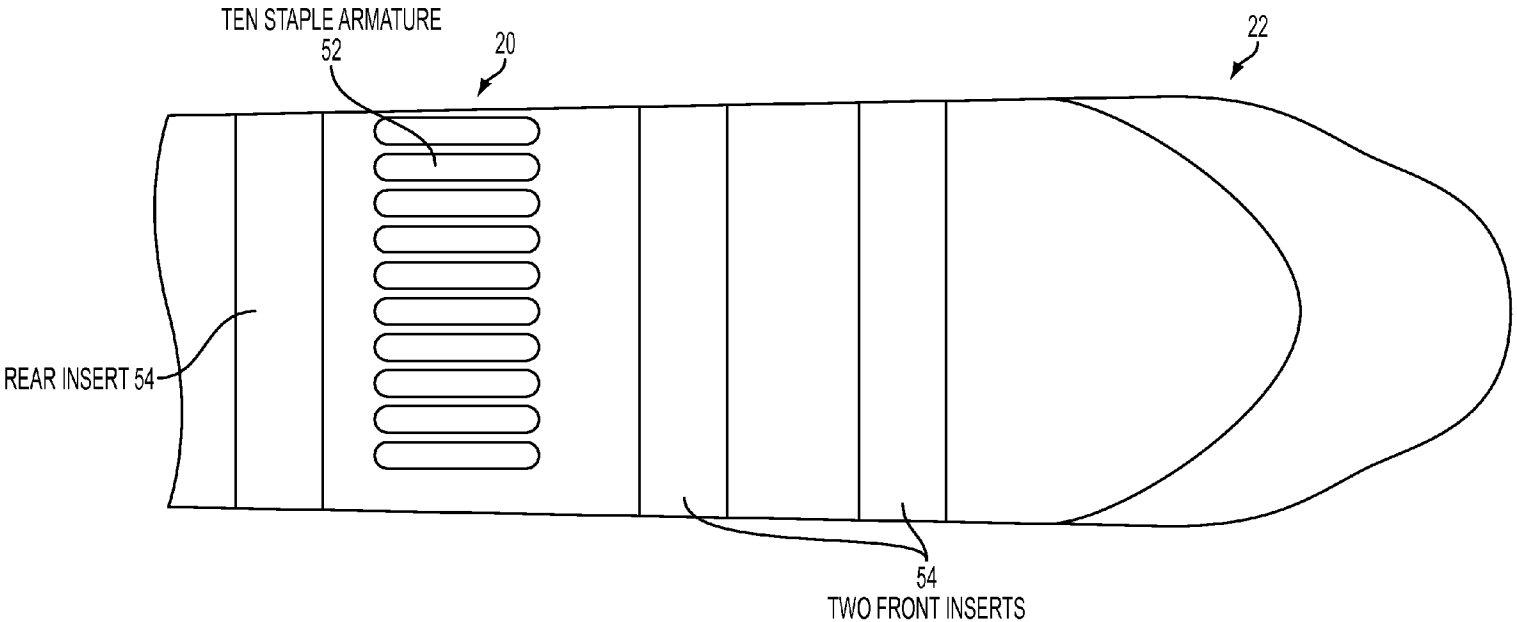
FIG. 4 shows an armature-projectile with lubricating/conditioning pads positioned fore and all of the armature according to the invention.

Referring now to FIGS. 2-4, in one embodiment the projectile 22 has a body 44 having a bullet-type geometry, that is, with a tapered nose portion 46 and where body 44 has a geometry so as to be fit into and be slidably received within bore 18, which in the embodiment shown in FIG. 1 accepts a square cross-sectional body 44 (although of course it should be understood that other mutually compatible (projectile-bore) geometries are also within the scope of the present invention). Each of ten conductive copper wires is threaded into a hole drilled into the top surface 48 of projectile 22 at its aft end 50 and bent into a receiving slot milled into surface 48 that extends aft from the drilled hole to thereby form ten armature conducting contacts or "staples" 52 that together make up armature 20 (each contact is alternatively referred to as a "staple" because its geometry resembles a staple or at least part of a staple, in that it has a lengthwise portion, positioned in the milled slot, and one 90 degree bent end positioned in the drilled hole). Body 44 is fabricated from a nonconducting material, and for test purposes and ease of fabrication was Delrin®, a hard acetyl plastic material capable of withstanding the forces in the tested application. The exposed surface of each staple 52 was ground flat, then sanded with 400 then 600 grit carborundum (SiC) paper, then buffed to a bright finish by a cloth charged with rouge, and then cleaned with acetone. Staples 52 were then wiped with dilute acetic acid and then hand-rubbed with Rulon®, a lubricant and reconditioner further described below.

Body 44 also includes a Rulon insert lubricant and reconditioning pad 54 that serves to a) wipe and clean debris from the rail surface, b) texture the surface to reproduce an interfacial topography that optimizes electrical contact, and c) apply a fresh layer of lubricating film ahead of the armature/rail electrical contact. To insure that the reconditioning pad makes contact with the rail during the projectile's flight down the barrel, it should be relatively compliant for the following reason: After sliding begins, electrodynamic forces can subject the projectile to horizontal and vertical motions that displace the reconditioning pad from the rail. By choosing the proper compliance, the pad 54 will remain in contact with the rail during the projectile's flight down the barrel. Two methods of adjusting the compliance are proposed. First, the entire pad 54 should be spring-loaded against the rail by, for example, a thin piece of compliant rubber, e.g. rubber with elastic modulus from 0.2 to 20 MPa. This will insure that the pad 54 can remain in contact with the rail even when the armature and rail become displaced. A second method is to lower the compliance of the surface of the pad 54 at the sub millimeter scale. The reconditioning pad surface can be made much more compliant (softer) by 'texturing' the pad 54. For example, one could cut narrow channels in the pad's surface with microtome blades or razor blades. This would create flexible sheets of the pad material some 0.1 to 2 mms tall, attached to the bulk of the pad 54.

Finally, after sliding commences, the mechanical and electrical contact produced by the initial static loading of the armature against the rail will be augmented by electrodynamic forces. To maintain the maximum area of contacts between armature and rail during sliding, it is necessary to use armatures with multiple 'fingers' in contact with the rail; for example, an armature with a dozen solid wires instead of one solid piece of metal. A wire will be more compliant than a solid armature and will also move independently of the adjacent wire.

In addition to the one or more fore-mounted pads 54 projectile 22 may also include a pad 54 mounted aft, that is, in back of (with respect to the motion of travel through bore 18) armature 20, that operates to wipe away debris and oxide formed at the staple/rail interface as projectile 22 traverses bore 18.

Figure 5:
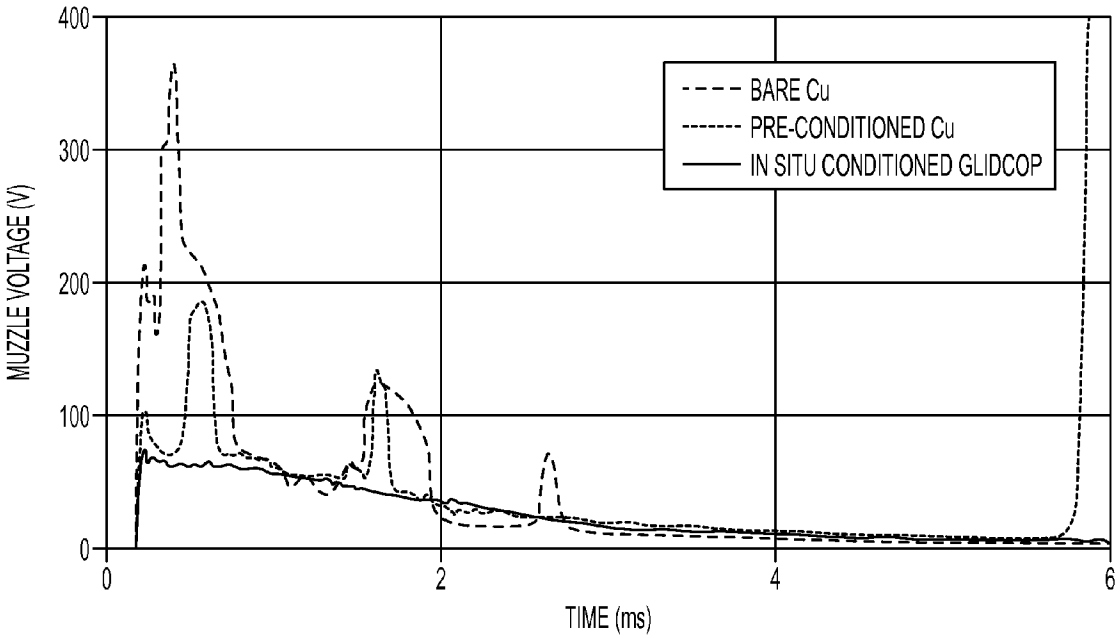
FIG. 5 is a graph comparing muzzle voltage vs. time for bare rails, conditioned rails and staples, and in situ conditioned rails and staples according to the invention.
Figure 6:
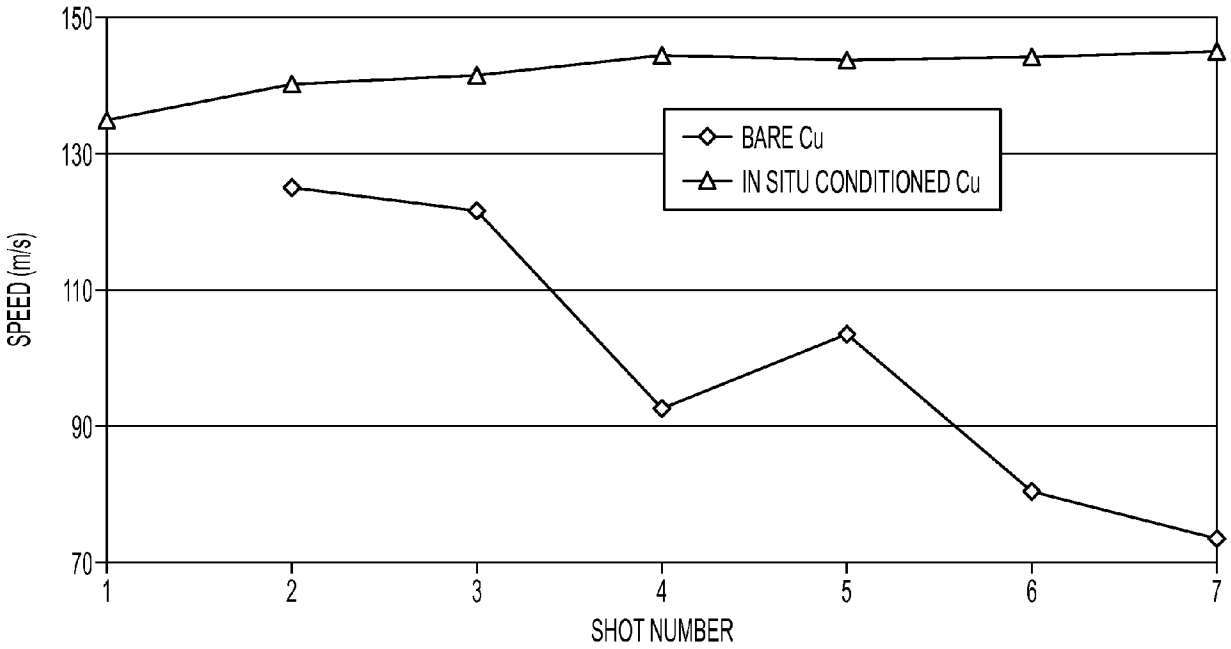
FIG. 6 is a graph comparing projectile exit speeds for bare rails and in situ conditioned rails and staples according to the invention.

Tests were conducted to compare the performance of launcher 10 with and without the above-described lubricating and reconditioning means. FIG. 5 is a graph of muzzle voltage vs. time for seven-shot tests on a) a bare copper armature, b) a preconditioned copper armature, and c) an in situ conditioned copper armature, that is, one that included a pad 54 as in the configuration of FIGS. 2-3. The untreated (bare) armature produced three broad, high voltage spikes, the preconditioned armature two smaller spikes, and the in situ conditioned armature produced no spikes. FIG. 6 is a graph of the projectile exit speed vs. shot number for the same tests, comparing just the bare and the in situ results. The former shows a marked decrease in exit speed with shot number increase due to the damage on the staples and/or rails. The speeds of shots with in situ conditioned rails remained high, and actually increased with shot number, due to decreased rail damage from wear and arcing.

Figure 7:
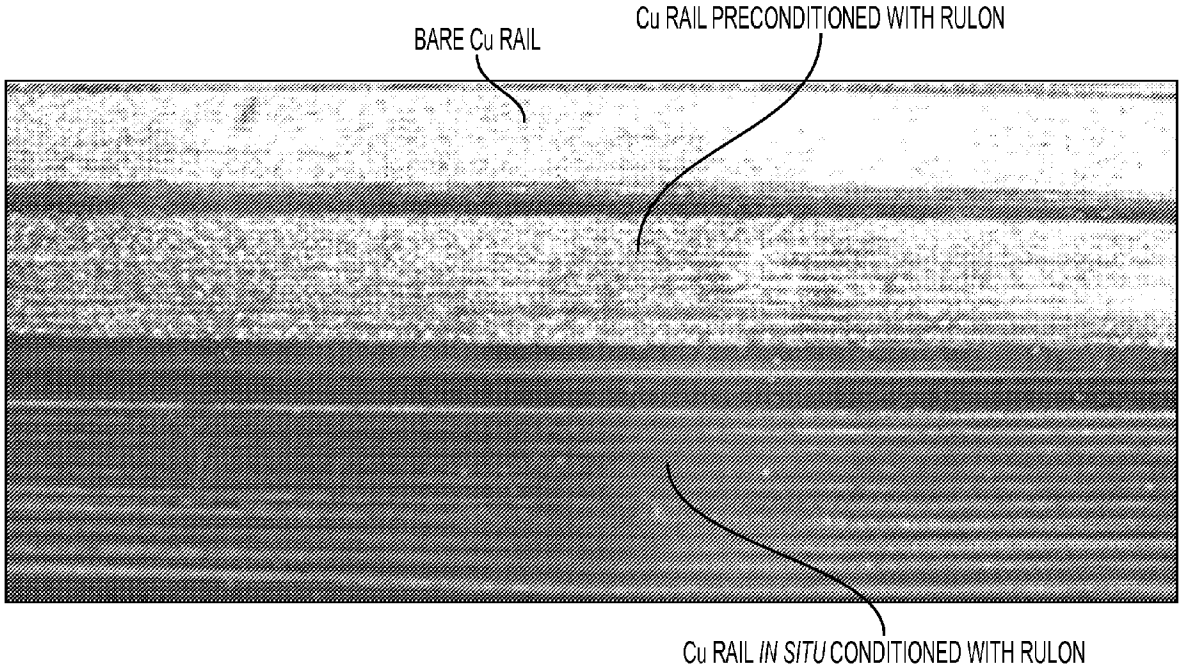
FIG. 7 shows photos of rails tested as in FIGS. 5-6.
Figure 8:
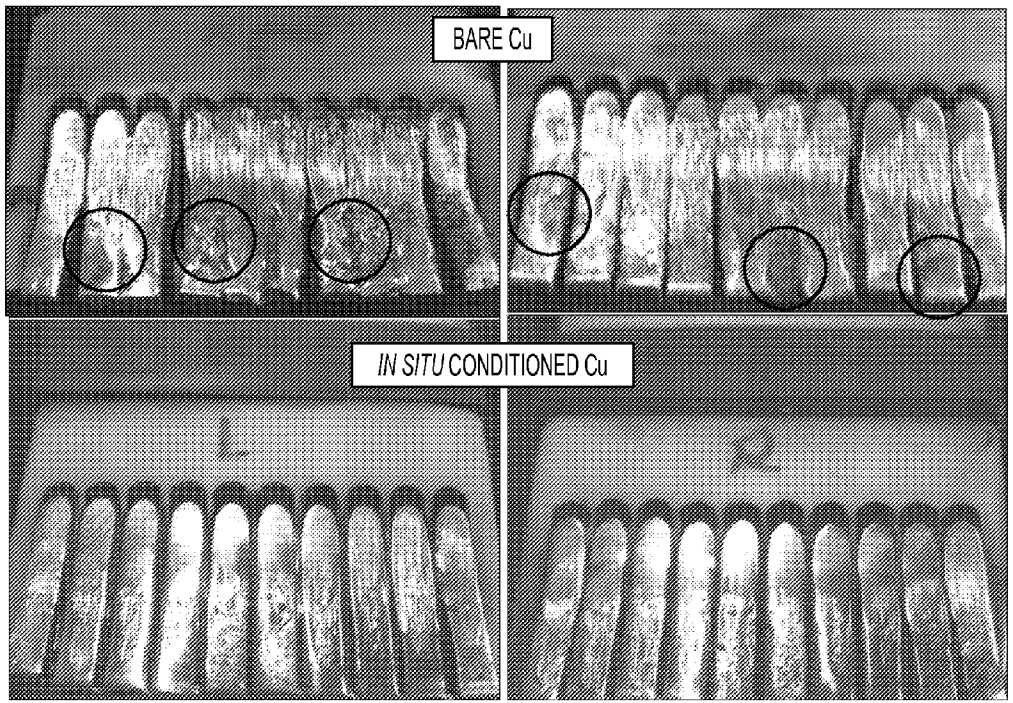
FIG. 8 shows photos of the armature staples of the bare and the in situ runs for the tests of FIGS. 5-6.

FIG. 7 shows photos of the midsection of the three left-side (negative polarity) main rails from the same tests, and it as evident that the bare rail had more shards of broken-off armature copper than either of the Rulon-conditioned rails, with the in situ conditioned rail having the fewest shards and being much less degraded. FIG. 8 show photos of the wear on the staples for the bare and the in situ tests. After one shot on the bare rail, the armature staples (top) already exhibit arc damage, brown deposits, abrasive scratches and eroded pits surrounded by smooth metal (circled areas). The bottom photos of the in situ test staples are after seven shots and show almost no wear to the armature staples.

Table 1 compares the performance of the bare and in situ conditioned copper rails and staples:

TABLE 1

| Parameter | Bare Cu | in situ conditioned Cu |
|---|---|---|
| Speed | Decreased 50% | Increased 7% |
| Muzzle voltage vs. time | Several big spikes | No spikes |
| Armature/rail damage | Arc damage, metal transfer, staples wore off | No arc damage, much less metal transfer, staples intact |

Figure 9:
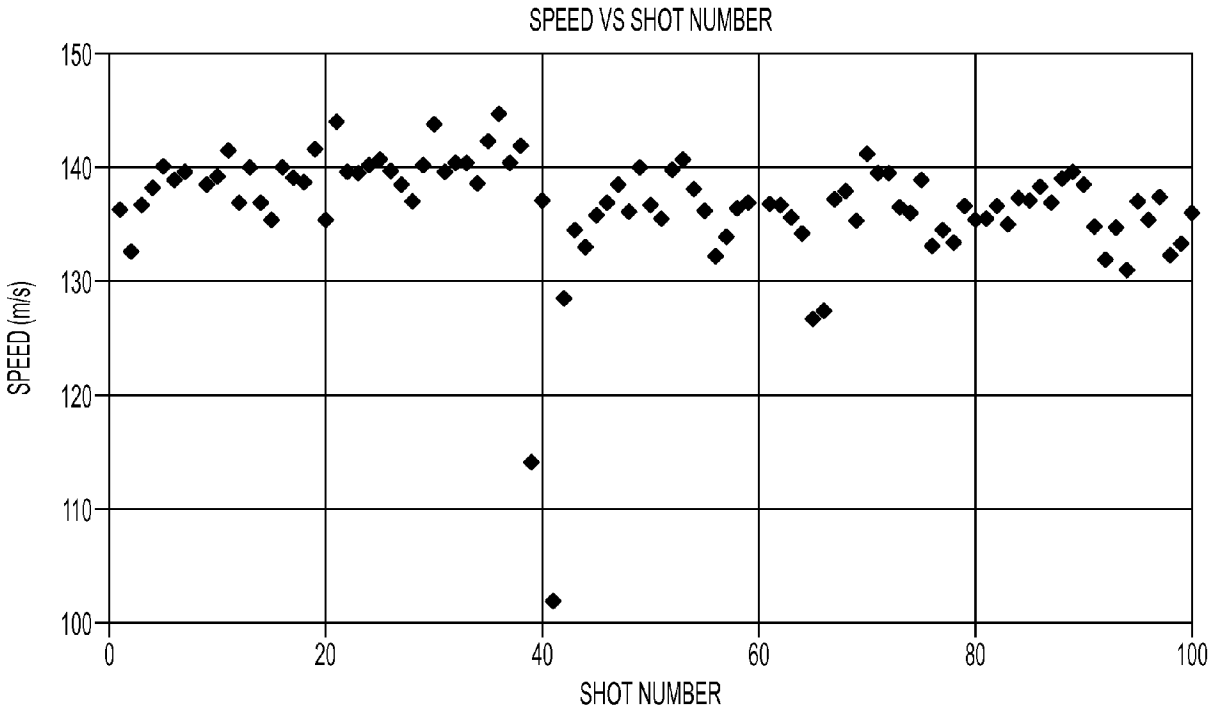
FIG. 9 is a graph of speed vs. shot number for a series of 100 shots of in situ conditioned rails and staples according to the invention.

Tests were subsequently run with in situ conditioned copper rails for a series of 100 shots, with the results shown in FIG. 9. The projectile exit speed remained nearly constant, with a mean exit speed of 137 m/s. The two lower-speed results around shot 40 were caused by a broken staple that was repaired for the subsequent shots.

Figure 10:
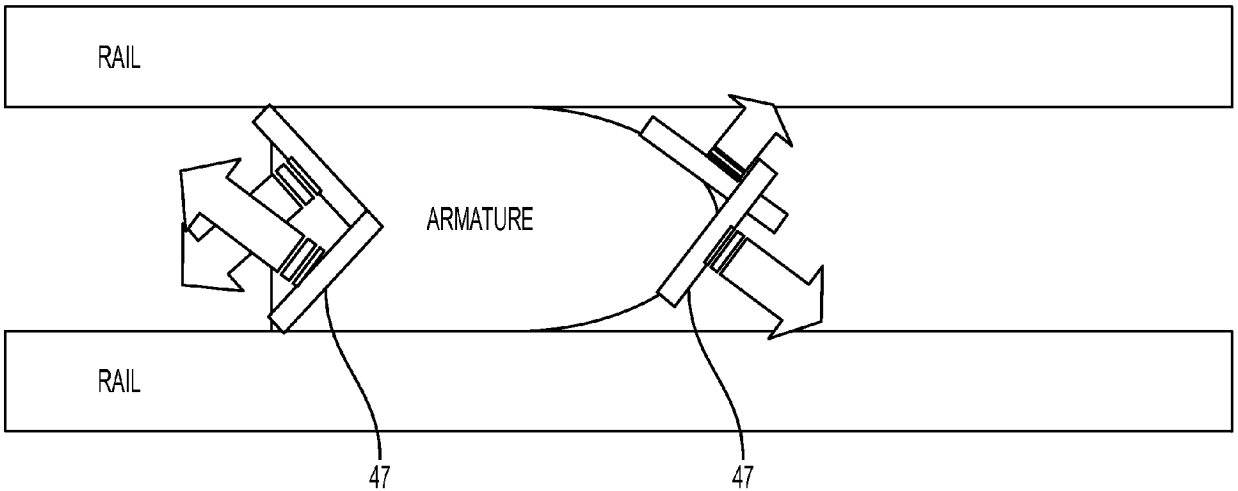
FIG. 10 is a schematic of the structure of FIG. 2 illustrating its operating functionality.
Figure 11:
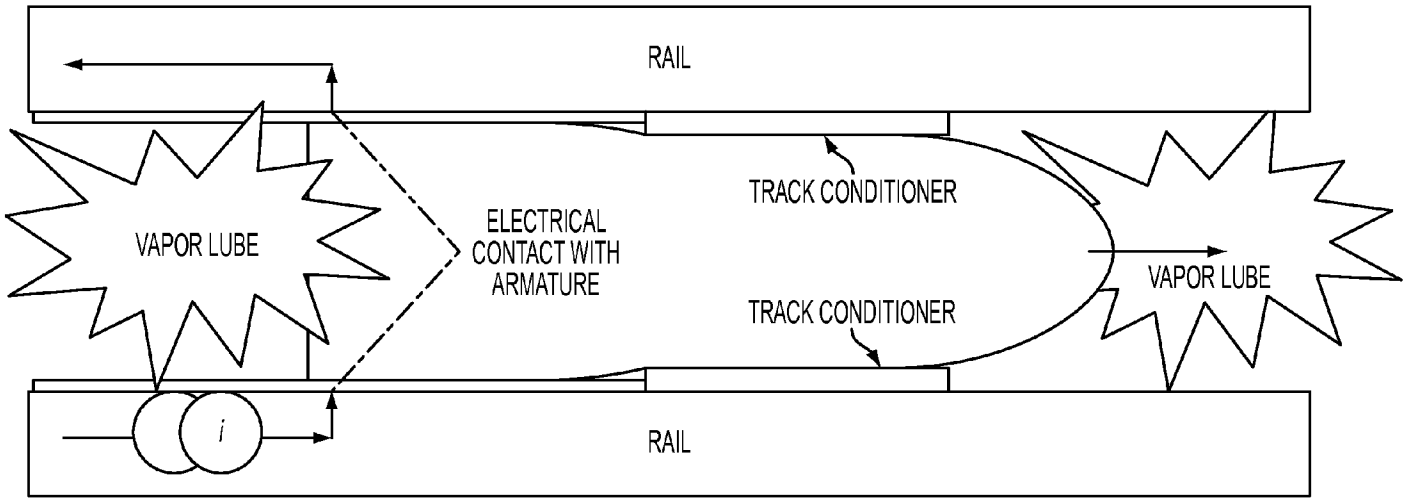
FIG. 11 is another schematic of the structure of FIG. 2 illustrating further details of its operating functionality.
Figure 12:
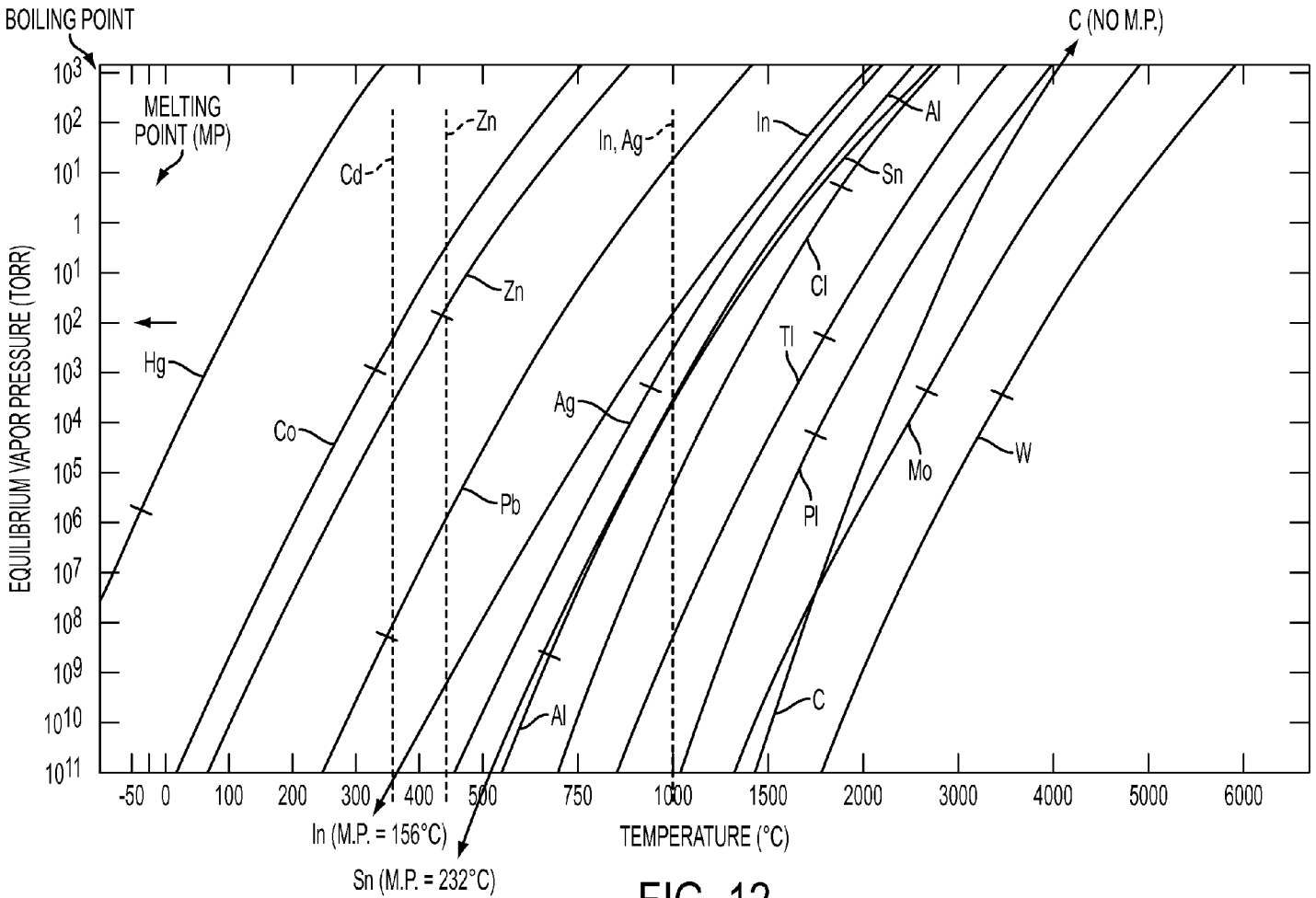
FIG. 12 is a graph showing vapor pressure curves of materials according to the invention.

Referring now to FIG. 10, in another embodiment a resistive metal foil strip 47 coated with low-vapor pressure metals is positioned on the armature 20 as shown such that the metal foil strip 47 contacts the rails 14 and 16. The current through the strip 47 provides the thermal energy to vaporize the metal and thus lubricate and protect rails 14 and 16 for subsequent shots. Accordingly, the vaporization occurs as the armature 20 heats up. FIG. 11 illustrates both embodiments together. FIG. 12 shows vapor pressure curves for exemplary metals useful as reconditioning lubricants. The predicted temperature profile of the armature 20 can accordingly be employed to select which low-vapor pressure metals should be applied in a given location. To insure that the preconditioned armature surface maintains a sufficient reservoir of solid lubricant, the armature should be 'textured' (by machining or abrasion). When the conditioner is rubbed onto a textured surface, solid lubricant will fill the valleys, which will act as a reservoir of solid lubricant. As the initial transfer film degrades, lubricant in the valley will be supplied to the contacts. Texturing that creates a peak-to-valley roughness between 0.1 and 1 micrometer suffices for rail guns up to 10 m long.

Referring again to FIG. 12, shown are metals with high vapor pressures at relatively low temperatures. Such vapors condense to form thin metal films that are softer than the armature/rail couples, e.g., Ag for Mo vs. Mo, and thus provide a lower shear-strength interface—hence lower friction coefficient—than the original armature/rail interface. Foils of these metals are placed either in front of the projectile or behind the projectile. As the projectile gets hotter, the foils disperse metallic vapors at the temperatures and rates shown. A second method of inducing vapor lubrication is to put an electrically resistive sheet on the front of the projectile, but in contact with the two rails. The sheet is preferably coated with a high vapor-pressure metal as discussed. As the sheet heats up (controlled by the sheet's resistance and rail voltage—6 to 20 volts typically, the metal evaporates and deposits ahead of the projectile.

A second class of material used as vapor phase lubricants are chosen to react with the rail surface to form lubricous layers. Sulfur, for example, can be used to form $MoS_2$ on Mo rails or to form $WS_2$ on W rails. A third class of material used as vapor phase lubricants can be known gunpowder additives (a prior art). They are dispersed by mounting behind the projectile a charge containing the additives then detonating the charge at selected locations down the barrel. The location can be chosen to place the vapor phase lubricants only where needed.

Composites can also be used as conditioners/lubricants. These include fiber-reinforced PTFE-based composites capable of withstanding temperatures to 400 C.; and, higher temperature composites (up to 800 C.) that contain soft metals, ceramics and high-temperature lubricating phases. Both materials are commercially available.

The PTFE-based composite was tested in preconditioning rails and armatures and as a reconditioning pad in a low velocity rail gun application. Using the methods discussed above, the PTFE-based composite protected Cu rails from virtually all metallic transfer that was deemed responsible for sliding damage and arcing damage to rails.

Regarding PTFE-formed SLIC films such as Rulon, it is advantageous that the matrix material is an intrinsically slippery material such as PTFE. Once a layer of PTFE transfers to a surface. PTFE does not transfer to any extent on top of that layer because PTFE has such a low surface energy, such that little, especially PTFE, adheres to it. A surface rubbed with pure PTFE, however, may accumulate thicker patches of PTFE fragments, due to unstable shear of PTFE. Rulon is a composite material containing both the abrasive phase and the SLIC phase, e.g. Rulon A (or Rulon AMR or Rulon LR), which contains upwards of 20% glass fibers (abrasives) in a PTFE matrix and may contain a few percent solid lubricant $MoS_2$ as well.

To avoid the latter, the composite should contain a percentage of finely-dispersed hard particles or whiskers that perform two functions. First, they will strengthen the matrix and prevent it from wearing fast. An example would be glass fiber reinforced PTFE, whose wear rate is 103 to 104 smaller than bulk PTFE. Moreover, since the harder particles will protrude from the softer matrix, the particles will behave as second-body abrasives that both thin out patches of transferred matrix material and plow transfer films into the metallic surface. Finally, a small percentage of a third phase of a very low friction material should be added act to reduce adhesion of the matrix to the rubbed surface. The latter will not be the dominant lubricous phase; however, it will make it easy to spread and transfer lubricant to the metallic surface. The third phase can be $MoS_2$ (or $WS_2$ or $WSe_2$) in a PTFE composite or a soft metal like Ag in a high temperature lubricant composite.

Thin transfer films of lubricant like PTFE protect rail gun surfaces in many ways. A projectile spends less time in the breech if the static friction at start up is reduced. With the armature out of the starting gate sooner, the breech is less likely to be damaged during the initial high current pulse. A low friction film intervening between the sliding armature and the rail reduces the chance of metallic adhesion between the sliding couple, thereby reducing the transfer of metallic shards from the hotter (thus weaker) armature surface and the rail surface. PTFE has a very low surface energy (w=0.02 $mJ/m^2$) compared to metal oxides (w=1-5 $J/m^2$). Low surface energy, w, not only reduces the adhesion of a surface (to contaminants as well as other metals), it also decreases the force necessary to release shards of that might have attached to its surface (from sliding wear or arc erosion). The latter process is significant, as the release force (technically, fracture initiation force) scales as $\sqrt{w}$. Shards attached to rails will scratch armatures and promote arcing contacts. With fewer shards on the rail, subsequent shots are less likely to degrade the barrel.

In addition, thin PTFE transfer films protect rail surfaces in other ways. First, the very thin dielectric film increases the electrical conductivity of the rail/armature interface. A PTFE film, squeezed to a thickness of a nanometer or so by asperities loaded in contact, reduces the work function of the junction, thereby increasing the electrical conductivity of the Cu-film-Cu junction below that of Cu—Cu oxide-Cu junctions. Secondly, the PTFE fills the deeper valleys (roughness) where direct contact is unlikely. The PTFE in the valleys acts to: 1) suppress arcing (PTFE is an arc suppressant); 2) reduce oxidation of the metal surfaces heated by the local current; 3) minimize wetting of the rail by molten metal; and 4) act as a reservoir of PTFE in case local areas become worn down. Finally, the process of rubbing the composite against the rail (and armature) cleans the surface of debris, burrs and adventitious surface films accumulated during preparing the rail for assembly.

A second class of composites useful as conditioners contains phases that provide both low friction and mild abrasion over a wide temperature range, from 25° C. to 800° C. The NASA composite, designated as the PS300 series, is a good example. These are composed of phases that are mildly abrasive but provide low friction in sliding contact over the temperature range from 25 C. to 800 C. We have conducted room temperature sliding tests with steel sliding against hard steel (52100) or a Cr-plated steel. When PS300 composites were used as transfer pads, metal-to-metal wear was reduced dramatically. The PS300 series composites are very hard (10-12 GPa), harder than hardened steel. This makes them well suited as conditioning pads for very hard rails or rails surfaced with hard-coatings, like Cr plating. Also, because they remain lubricous up to 800 C., they can be placed on or very near the metal armature and allowed to heat up. Table 2 lists the above two composites and some of their properties.

TABLE 2

Conditioner for Rail Guns

| NAME/CLASS | COMPOSITION | T max (C.) | Friction Coefficient |
|---|---|---|---|
| PTFE-based composite[1] | PTFE + glass fibers + 5% $MbS_2$ | 400 | 0.1-0.2 |
| NASA PS300 series[2] | 60% $Cr_2O_3$. 20% NiCr and 10% each of Ag and $BaF_2/CaF_2$ eutectic | 800 | 0.2-0.3 |

[1]San Gobain, JPM (Hattiesburg. MS) and others

Table 3 lists several other materials that have been used as protective coatings for high speed or high temperature sliding. Intercalated graphite and the Westinghouse compact could be used as matrix materials for lubricous composites and thin metalized diamond-like carbon could be used as low-friction, protective films on one-shot armatures.

TABLE 3

Solid lubricant for Rail Guns

| NAME/CLASS | COMPOSITION | Tmax (° C.) | Friction Coef-ficient |
|---|---|---|---|
| Intercalated Graphite[1] | $CdCl_2$-graphite<br>$CrCl_3$-graphite | 700<br>800 | 0.1-0.2 |
| "Westinghouse Compact"[2] | 90% $WSe_2$/10% Ga—In | 650 | 0.1-0.3 |
| Metallized Diamond-like Carbon[3] | C:H:Me where Me = Ag, Si, W, Ti, . . . | 500-800 | 0.1-0.2 |

[1]DARPA report WRDC-TR-90-4096 (Final report for September 1985 to September 1989, Vol. 1, Summary)
[2]DARPA report AFWAS-TR-83-4129 (Final report covering 1978-1983, part 2, Vol. 1, Summary)
[3]Commercially available from several manufacturers Obviously many modifications and variations of the present invention are possible in the light of the above teachings. It is therefore to be understood that the scope of the invention should be determined by referring to the following appended claims.

What is claimed as new and desired to be protected by Letters Patent of the United States is:

1. In an electromagnetic rail gun launcher comprising a set of spaced-apart rails defining a bore there between for slidably receiving a projectile having an armature thereon, and wherein the rail gun and armature are configured such that when powered up the projectile and armature are forced through the bore from a breech of the rail gun toward a muzzle of the rail gun to thereby launch the projectile, the improvement comprising a first lubricant reconditioning pad, containing a lubricant, secured to the projectile and positioned such that the pad contacts the rails to thereby clean debris from the rails while applying lubricant to the rails as the projectile moves through the bore to thereby lubricate and recondition the rails during operation of the rail gun.

2. The electromagnetic railgun launcher of claim 1, wherein the lubricant comprises polytetrafluoroethylene (PTFE).

3. The electromagnetic railgun launcher of claim 2, wherein the lubricant further comprises about 5% $MoS_2$ and about 20% glass fibers in a PTFE matrix.

4. The electromagnetic railgun launcher of claim 1, wherein a surface of the first pad in contact with the rails is textured.

5. The electromagnetic railgun launcher of claim 1, wherein the first pad is positioned fore of the armature.

6. The electromagnetic railgun launcher of claim 5, further comprising a second lubricant reconditioning pad positioned aft of the armature.

7. In an electromagnetic rail gun launcher comprising a set of spaced-apart rails defining a bore there between for slidably receiving a projectile having an armature thereon, and wherein the rail gun and armature are configured such that when powered up the projectile and armature are forced through the bore from a breech of the rail gun toward a muzzle of the rail gun to thereby launch the projectile, the improvement comprising a resistive metal foil strip coated with a low-vapor pressure metal positioned on the armature such that the metal foil strip contacts the rails to thereby lubricate and recondition the rails during operation of the rail gun.

8. The electromagnetic railgun launcher of claim 7, wherein the armature has a surface that is textured.

9. The electromagnetic railgun launcher of claim 7, wherein a predicted temperature profile of the armature determines which metal that is selected from a group consisting of different low-vapor pressure metals is applied selectively to one or more locations of the armature.

10. The electromagnetic railgun launcher of claim 7, wherein the metal is selected such that when heated it forms a vapor that upon condensing onto the rail forms a thin metal film that is softer than either the armature or the rail.

11. A method of conditioning a surface of a rail in an electromagnetic rail gun, wherein the rail gun includes a set of spaced-apart rails defining a bore there between for slidably receiving a projectile having an armature thereon, the projectile having a first in situ lubricant reconditioning pad thereon fore of the armature and positioned so as to contact the rails, and the rail gun and armature are configured such that when powered up the projectile and armature are forced through the bore from a breech of the rail gun toward a muzzle of the rail gun to thereby launch the projectile, comprising applying an in situ lubricant to the rail surface with the first pad as the projectile traverses the bore.

12. The method of claim 11, wherein the lubricant is polytetrafluoroethylene (PTFE).

13. The method of claim 12, wherein the lubricant further comprises about 5% $MoS_2$ and about 20% glass fibers in a PTFE matrix.

14. The method of claim 1, wherein a surface of the pad in contact with the rails is textured.

15. The method of claim 11, wherein the lubricant is a low-vapor pressure metal.

16. The method of claim 15, wherein the armature has a surface that is textured.

17. The method of claim 15, wherein a predicted temperature profile of the armature determines which metal that is selected from a group consisting of different low-vapor pressure metals is applied selectively to one or more locations of the armature.

18. The method of claim 17, wherein the metal is selected such that when heated it forms a vapor that upon condensing onto the rail forms a thin metal film that is softer than either the armature or the rail.

19. The method of claim 11, further comprising positioning a second in situ lubricant conditioning pad aft of the armature in contact with the rails, and wiping away debris and oxide formed on the rails with the second pad as the projectile traverses the bore.

* * * * *